US005841328A

United States Patent [19]

Hayashi

[11] Patent Number: 5,841,328

[45] Date of Patent: Nov. 24, 1998

[54] DIRECTIONAL COUPLER

[75] Inventor: Katuhiko Hayashi, Tokyo, Japan

[73] Assignee: TDK Corporation, Tokyo, Japan

[21] Appl. No.: 737,816

[22] PCT Filed: Mar. 16, 1995

[86] PCT No.: PCT/JP95/00445

§ 371 Date: Nov. 19, 1996

§ 102(e) Date: Nov. 19, 1996

[87] PCT Pub. No.: WO95/32527

PCT Pub. Date: Nov. 30, 1995

[30] Foreign Application Priority Data

May 19, 1994 [JP] Japan ..... 6-105490

[51] Int. Cl.[6] ..... H01P 5/18

[52] U.S. Cl. ..... 333/116; 333/238

[58] Field of Search ..... 333/109, 112, 333/116

[56] References Cited

U.S. PATENT DOCUMENTS

| | | | |
|---|---|---|---|
| 3,723,914 | 3/1973 | Cappucci | 333/112 |
| 3,999,150 | 12/1976 | Caragliano et al. | 333/116 |
| 5,329,263 | 7/1994 | Minami | 333/116 |
| 5,359,304 | 10/1994 | Fujiki | 333/116 |
| 5,369,379 | 11/1994 | Fujiki | 333/116 |

FOREIGN PATENT DOCUMENTS

| | | |
|---|---|---|
| 0641037 A1 | 3/1995 | European Pat. Off. . |
| 95372 | 8/1970 | France . |
| 51-78671 | 7/1976 | Japan . |
| 54-51445 | 4/1979 | Japan . |
| 54-86249 | 7/1979 | Japan . |
| 5-152814 | 6/1993 | Japan . |
| 5-160614 | 6/1993 | Japan . |
| 5-191115 | 7/1993 | Japan . |
| 6-61709 | 3/1994 | Japan . |

*Primary Examiner*—Paul Gensler
*Attorney, Agent, or Firm*—Frishauf, Holtz, Goodman, Langer & Chick, P.C.

[57] ABSTRACT

A directional coupler includes first and second dielectric layers, and an intermediate dielectric layer disposed therebetween. The first dielectric layer has one surface formed with a first coupling line, and the second dielectric layer has one surface formed with a second coupling line. Outside the first dielectric layer, there is a third dielectric layer with a grounding electrode on a surface thereof. Outside the second dielectric layer, there is a fourth dielectric layer with a grounding electrode on a surface thereof. The dielectric layers are laminated together so that a dielectric layer is interposed between the grounding electrode and an adjacent one of the coupling lines. The first and second coupling lines are aligned with each other in the direction of laminate. Each of the first and second coupling lines has a spiral configuration including first to fifth sequential portions. The first portion is substantially parallel with an edge of the dielectric layer on which the line is formed. Each of the second to fifth portions is connected with and perpendicular to the preceding portion, with the fifth portion being inside the first portion.

15 Claims, 5 Drawing Sheets

DIRECTIONAL COUPLER

TECHNICAL FIELD

The present invention relates to a directional coupler for electromagnetically coupling a signal input primary line with an auxiliary line. More specifically, the present invention pertains to a directional coupler having conductors provided on a layer of a dielectric material to thereby provide paired lines to be coupled.

BACKGROUND ART

The U.S. Pat. No. 5,329,263 issued on Jul. 12, 1994 to Kazuaki Minami discloses a directional coupler having a dielectric substrate provided on one side surface with a conductive grounding electrode which extends throughout the surface and on the other side surface with paired signal transmitting coupling lines of a conductive material. These lines are formed on the surface of the substrate by parallelly extending portions, each of the parallelly extending portions of the coupling lines having opposite ends provided with leads which extends perpendicularly to the parallelly extending portions.

One of the coupling lines is connected through the lead at one end thereof with an input port and through the lead at the other end with an output port. The other coupling line is connected through the lead at one end with a second output port and through the lead at the other end with an isolation port. The coupling lines and the leads are connected together through a deposition of a conductive metal such as gold.

In this type of coupler, the isolation port is connected normally to the ground. As a signal is applied to the input port of the one coupling line, a corresponding signal is produced at the output of the one coupling line. A signal is also produced through electromagnetic coupling between the paired coupling lines at the second output port of the other coupling line. When an input signal is applied to the output port of the one coupling line an output is produced at the input port of the one coupling line, and at the same time an output is produced at the second output port of the other coupling line with a level which is different from the level when the input signal is applied to the input port. The difference in the signal level at the second output port of the other coupling line between the occasion when the input signal is applied to the input port of the one coupling line and the occasion when the input signal is applied to the output port is defined as the directionality or isolation of the coupler.

It has been recognized that the coupler shows a large directionality in response to an input signal wherein the length of the parallelly extending coupling lines is equal to ¼ of the wavelength. It is noted further that the coupling power of the coupler is dependent on the distance between the coupling lines whereby a tight coupling is produced with a small distance whereas a weak coupling is produced with a large distance. In the coupler of the type disclosed by the aforementioned U.S. patent, the coupling lines are formed on a surface of the dielectric substrate. It should however be noted that the coupling lines may be embedded in the body of the dielectric body. In that case, the effective line wavelength is decreased to $\lambda/4\ \epsilon_r$, where $\epsilon_r$ designates a specific dielectric constant and $\lambda$ the wavelength of the input signal. Thus, the coupler size can be decreased by using a material of higher specific dielectric constant. It should therefore be understood that a dielectric material of an appropriate specific dielectric constant may be used for decreasing the size of a directional coupler.

In the case where a dielectric body is of a laminated structure wherein a plurality of dielectric layers are laid one over the other, the coupling lines can be provided between adjacent dielectric layers. In this structure, the paired coupling lines may be arranged on the opposite sides of a dielectric layer.

In a directional coupler having coupling lines embedded in a dielectric body as described, the dielectric layers are generally formed of a material of a high dielectric constant. However, using a dielectric material of high dielectric constant is likely to cause a decrease in impedance of the signal line conductor, so that it is required to increase the distance between the signal line conductor and the ground electrode or to decrease the width of the signal line conductor. Dielectric layers are formed by sintered ceramics. It should therefore be noted that to increase the distance between the signal line conductors and the ground electrode will cause a corresponding increase in the thickness of the dielectric layer. Thus, an increased time will be required for sintering process to remove binder and an increased processing time will therefore be required for manufacture. Particularly, in a structure wherein paired signal lines are provided at the opposite sides of a dielectric layer, the thickness of the dielectric substrate is undesirably increased so that the structure is disadvantageous in making the device compact. It should further be noted that the structure having a decreased signal line conductor width involves another problem of transmission loss in the signal line conductor being increased.

DISCLOSURE OF THE INVENTION

The present invention is therefore aimed to solve the aforementioned problems in conventional directional coupler and has an object to provide a directional coupler which is compact and thin in structure and easy to manufacture.

Another object of the present invention is to provide a directional coupler of a high isolation characteristics.

According to the present invention, in order to accomplish the above objects, a first dielectric layer is provided at least on one surface with a first coupling line and a second dielectric layer is provided at least on one surface with a second coupling line, the dielectric layers being laid one over the other so that the first and second coupling lines are aligned with each other with dielectric material interposed therebetween, two outer dielectric layers each having a grounding electrode extending to cover substantially throughout the surface thereof, the outer dielectric layers being laid over outer surfaces of the first and the second dielectric layers respectively with dielectric material interposed between the coupling lines and the grounding electrodes, each of the first and second coupling lines being of a convolute configuration of at least ⅓ turn. The term convolute configuration as herein used means a configuration corresponding to at least a portion of at least one turn of a spiral configuration.

According to one aspect of the present invention, the directional coupler comprises a first dielectric layer having a first coupling line formed on one surface thereof, a second dielectric layer having a second coupling line formed on one surface thereof, an intermediate dielectric layer disposed between the first and second dielectric layers, a third dielectric layer disposed outside the first dielectric layer and having a grounding electrode extending substantially throughout a surface thereof, a fourth dielectric layer disposed outside the second dielectric layer and having a grounding electrode extending substantially throughout a surface thereof, the layers being laid one over the other with a dielectric layer interposed between each grounding electrode and adjacent one of the coupling lines, the first and second coupling lines being arranged so that they are aligned with each other in a direction of laminate, each of the first and second coupling lines being of a spiral configuration including a first portion which extends in parallel with one edge of the dielectric layer on which the coupling line is formed, a second portion having one end connected with one end of the first portion and extending substantially perpendicularly to the first portion, a third portion having one end connected with the other end of the second portion and extending substantially perpendicularly to the second portion, a fourth portion having one end connected with the other end of the third portion and extending substantially perpendicularly to the third portion, and a fifth portion having one end connected with the other end of the fourth portion and located inside the first portion to extend substantially perpendicularly to the fourth portion.

Outside the grounding electrode, there is formed at least one dielectric layer to provide a protective layer. For the purpose, either one or both of the third and fourth dielectric layers may be disposed so that the grounding electrodes formed thereon are located inside the respective layers, or alternatively, a further dielectric layer may be laid over the third or fourth dielectric layer. In the structure of this aspect, each of the first, and second coupling lines are connected at the other end of the first portion and the other end of the fifth portion with leads which are extending to an edge portion of the laminated structure to form external connecting ports. For the purpose, the other end of the first portion may be connected through a lead to a port on the edge portion of the laminated structure. The other end of the fifth portion may be connected through the dielectric layer adjacent to the coupling line with a lead formed on a surface of another dielectric layer which is in turn connected with the port on the edge portion of the laminated structure.

In the directional coupler of the present invention, each of the first and second coupling lines may be formed in two or more dielectric layers. It should further be noted that in accordance with the present invention each of the coupling lines preferably has an outermost edge which is located in a projection in the direction of laminate thickness inside by a predetermined distance from the edge of the grounding electrode. It is possible to accomplish an extremely excellent isolation characteristics by choosing the predetermined distance at least 0.3 mm, preferably 0.45 mm.

In accordance with a further aspect of the present invention, the dielectric layers at the opposite sides of each of the first and second coupling lines are formed of a material having a high specific dielectric constant, and other dielectric layers from a material having a relatively low specific dielectric constant. This structure provides advantages in that the signal wavelength can be decreased due to the dielectric layers of a high specific dielectric constant at the opposite sides of each coupling line, and it is not necessary to increase the substrate thickness because the line impedance will not be substantially increased by forming the other dielectric layers from a material of relatively low specific dielectric constant.

BEST MODE FOR CARRYING OUT THE INVENTION

Figure 1:
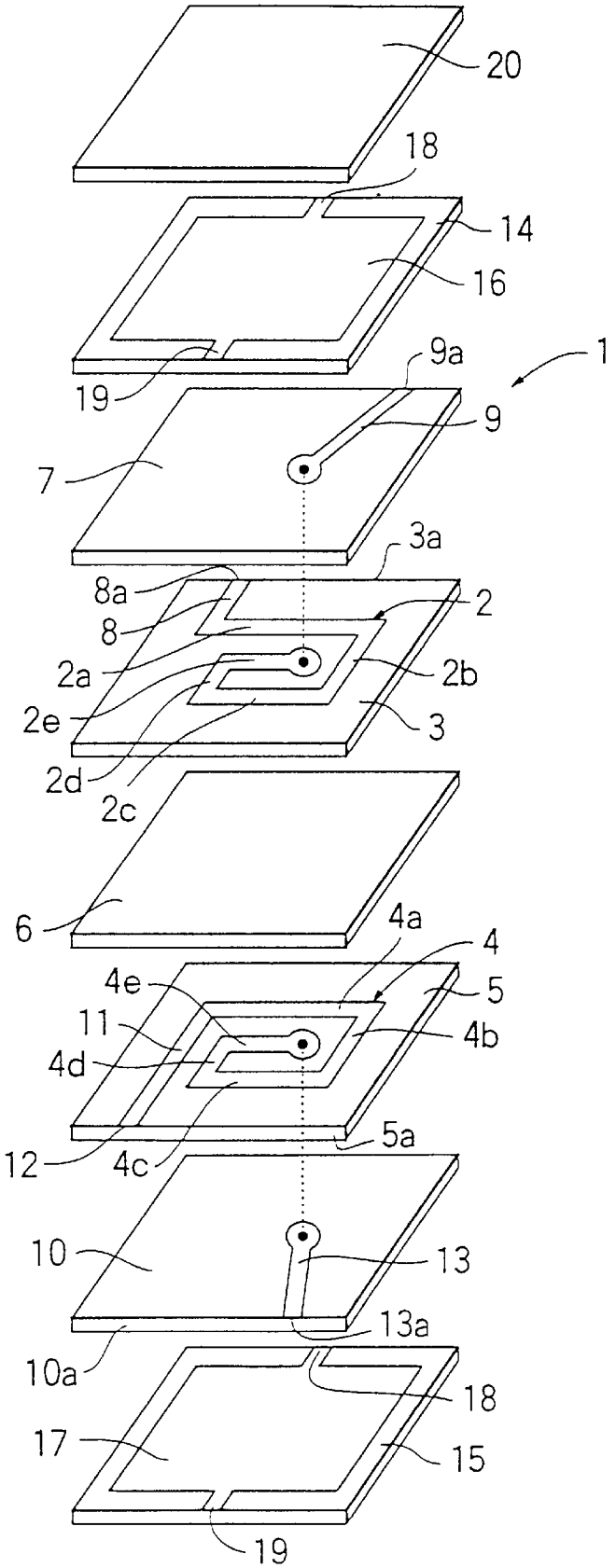
FIG. 1 is an exploded perspective view of a directional coupler of a laminated structure in accordance with the present invention.

The present invention will now be described with reference to embodiments. Referring first to FIG. 1, there is shown a directional coupler 1 in accordance with one embodiment which is formed by sintering a plurality of laminated green sheets of dielectric material. The coupler 1 includes a first dielectric layer 3 having a first coupling line 2 formed thereon, a second dielectric layer 5 having a second coupling line 4 formed thereon, and an intermediate dielectric layer 6 disposed between the dielectric layers 3 and 5.

The first coupling line 2 is formed on the top surface of the first dielectric layer 3. The coupling line 2 is of a spiral configuration including a first portion 2*a* extending substantially in parallel with an edge 3*a* of the first dielectric layer 3, a second portion 2*b* having one end connected with one end of the first portion 2*a* and extending substantially perpendicularly to the first portion 2*a*, a third portion 2*c* having one end connected with the other end of the second portion 2*b* and extending substantially perpendicularly to the second portion, a fourth portion 2*d* having one end connected with the other end of the third portion and extending substantially perpendicularly to the third portion 2*c*, and a fifth portion 2*e* having one end connected with the other end of the fourth portion 2*d* and located inside the first portion 2*a* to extend substantially perpendicularly to the fourth portion 2*d*.

The second coupling line 4 is formed on the top surface of the second dielectric layer 5. The second coupling line 4 includes a first portion 4*a*, a second portion 4*b*, a third portion 4*c*, a fourth portion 4*d* and a fifth portion 4*e* which are aligned in the direction of laminate thickness to the first portion 2*a*, the second portion 2*b*, the third portion 2*c*, the fourth portion 2*d* and the fifth portion 2*e*, respectively. In accordance with the present invention, a satisfactory result can be obtained with the coupling lines 2 and 4 each having the first to third portions. In this instance, the coupling line comprised of the first to third portions constitute a part of a spiral configuration. The term "convolute configuration" is herein used to include this configuration as well as a spiral configuration.

A second intermediate dielectric layer 7 is laid over the first dielectric layer 3. The first portion 2*a* of the first coupling line 2 formed on the first dielectric layer 3 has an end connected with a lead 8 which is in turn connected with a first port 8*a* provided on an edge 3*a* of the first dielectric layer 3. The second intermediate dielectric ,layer 7 is provided on the top surface with a lead 9. The lead 9 has one end connected through the dielectric layer 7 with an end of the fifth portion 2*e* of the first coupling line 3. The lead 9 extends to an edge portion of the dielectric layer 7 to be connected with a second port 9*a* formed thereon.

A third intermediate dielectric layer 10 is provided beneath the second dielectric layer 5. The first portion 4*a* of the second coupling line 4 formed on the second dielectric layer 5 has an end connected with a lead 11 which is in turn connected with a third port 12 formed on an edge 5*a* of the second dielectric layer 5, the edge 5*a* being at a side opposite to the side where the edge 3*a* is located on the first dielectric layer 3. The third intermediate dielectric layer 10 is formed on the top surface with a lead 13. The lead 13 has one end which is connected through the dielectric layer 5 with an end of the fifth portion 4*e* of the second coupling line 4. The other end of the lead 13 is connected with a fourth port 13*a* which is provided on an edge 10*a* of the dielectric layer 10, the edge 10*a* being vertically aligned with the edge 5*a* of the second dielectric layer 5.

Above the second intermediate dielectric layer 7, there is laminated a third dielectric layer 14 for a grounding electrode. Similarly, a fourth dielectric layer 15 is laminated beneath the third intermediate dielectric layer 10 for another grounding electrode. A grounding electrode 16 is formed on the top surface of the third dielectric layer 14 to cover substantial part of the surface. Similarly, a grounding electrode 17 is formed on the top surface of the fourth dielectric layer 14. The grounding electrodes 16 and 17 are connected with grounding ports 18 and 19 provided at the opposite side edges of the dielectric layers. A dielectric layer 20 is laminated on the top surface of the third dielectric layer 14 to provide a protective layer.

Figure 2:
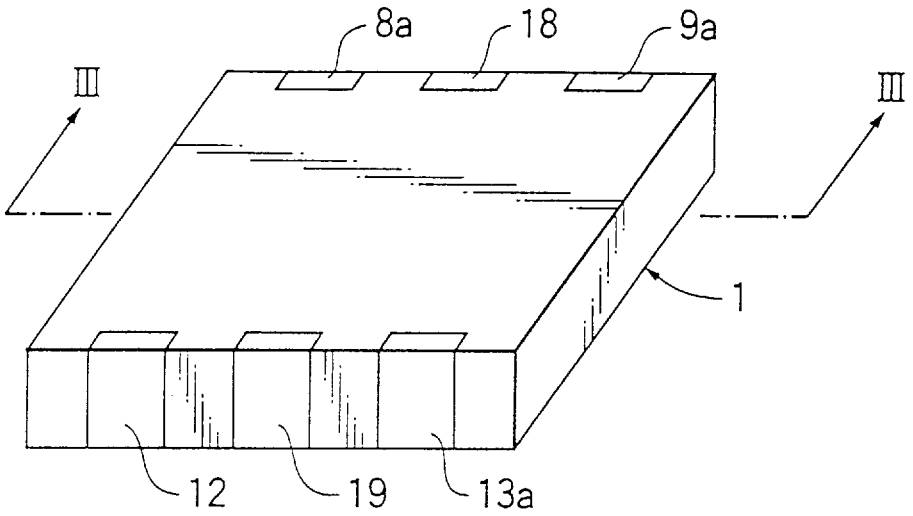
FIG. 2 is a perspective view showing an external appearance of the directional coupler shown in FIG. 1.
Figure 3:
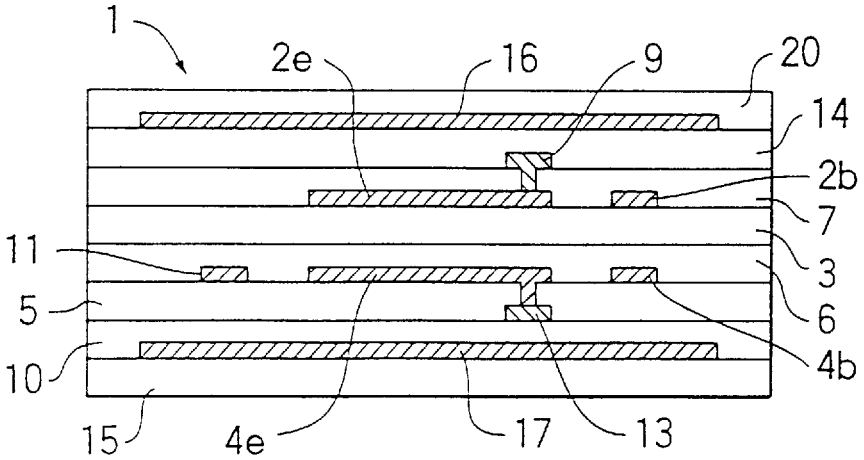
FIG. 3 is a sectional view taken along the line III—III in FIG. 2.

The directional coupler 1 of the aforementioned laminated structure is shown in FIG. 2. The coupler 1 has port electrodes for providing ports 8*a*, 9*a*, 12, 13*a*, 18 and 19 at edge portions thereof. FIG. 3 shows a section of the coupler 1. In this embodiment, the dielectric layers in the laminate are of the same specific dielectric constant.

Figure 4:
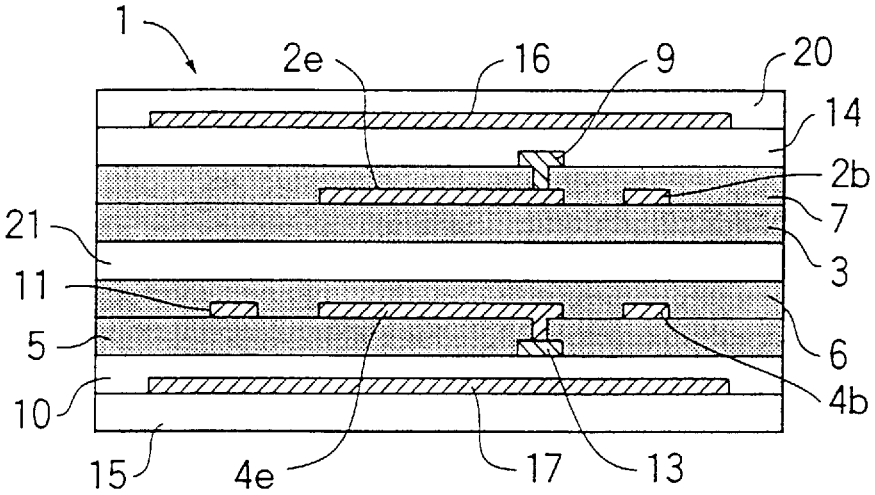
FIG. 4 is a sectional view similar to FIG. 3 but showing another embodiment of the present invention.

FIG. 4 is a sectional view similar to FIG. 3 but shows another embodiment. In this embodiment, corresponding parts are designated by the same reference characters as in the previous embodiment, and detailed description will be omitted. In this embodiment, another dielectric layer 21 is disposed between the first dielectric layer 3 and the intermediate dielectric layer 6. The first dielectric layer 3 and the second intermediate dielectric layer 7 which is located above the first dielectric layer 3 with the first coupling line 2 interposed therebetween, and the second dielectric layer 5 and the intermediate dielectric layer 6 which is located above the second dielectric layer 5 with the second coupling line 4 interposed therebetween are formed of a material having a high specific dielectric constant. The other dielectric layers are made of a material having a low specific dielectric constant. In this embodiment, it is possible to decrease the signal wavelength by providing the dielectric layers having a coupling line interposed therebetween with a high specific dielectric constant. Since the other dielectric layers are of a material having a low specific dielectric constant, the line impedance is not significantly decreased.

Figure 5:
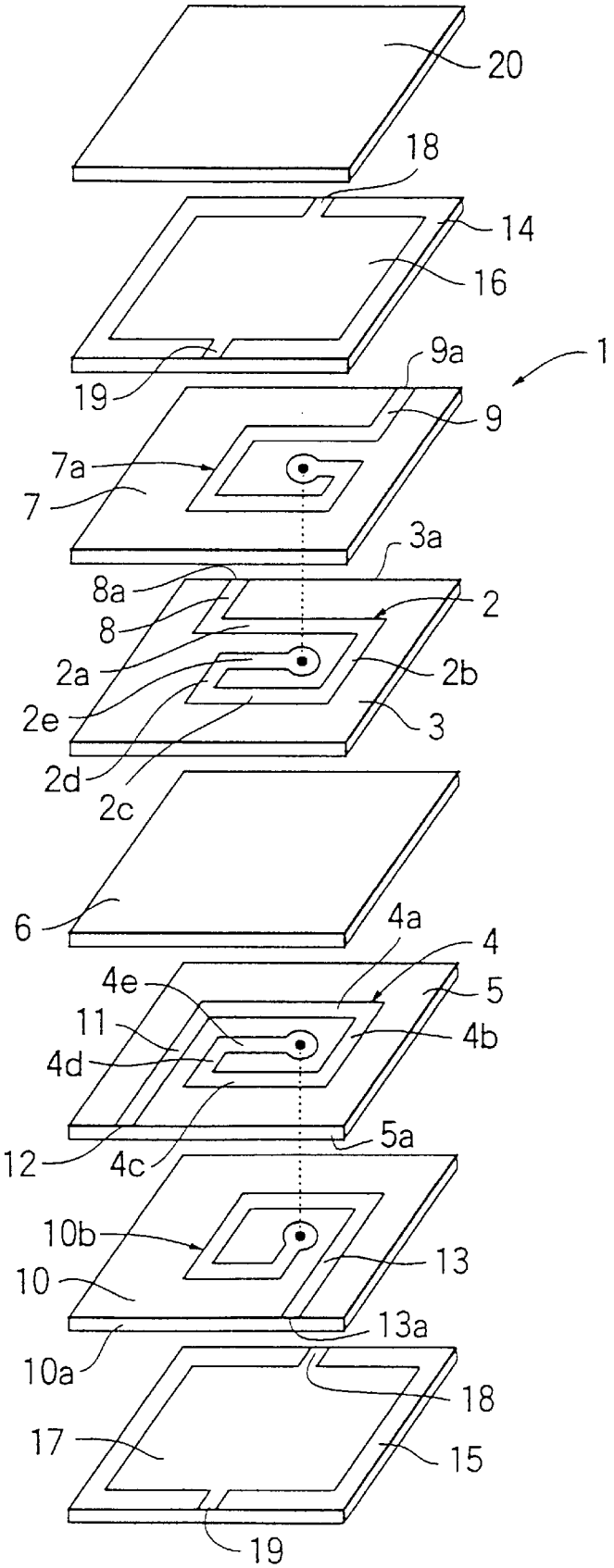
FIG. 5 is an exploded perspective view of a directional coupler similar to FIG. 1 but showing a further embodiment of the present invention; and, FIG. 6 is a diagram showing influences of the distance between edges of the coupling line and the grounding electrode on the isolation characteristics in the directional coupler in accordance with the present invention, wherein 6(*a*) is a sectional view of the coupler for showing the manner of measuring the distance, 6(*b*) a plan view showing projections in the direction of laminate thickness of the coupling line and the grounding electrode, 6(*c*) a diagram showing the isolation characteristics under the distance of 0.2 mm, and 6(*d*) a diagram showing the isolation characteristics under the distance of 0.45 mm.
Figure 6A:
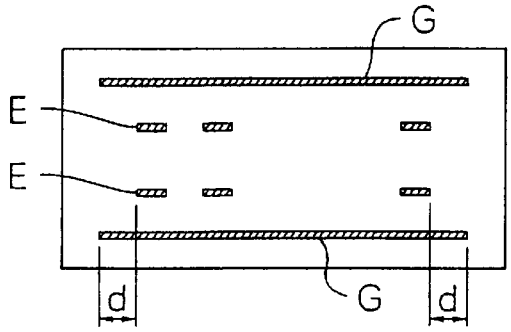
Figure 6B:
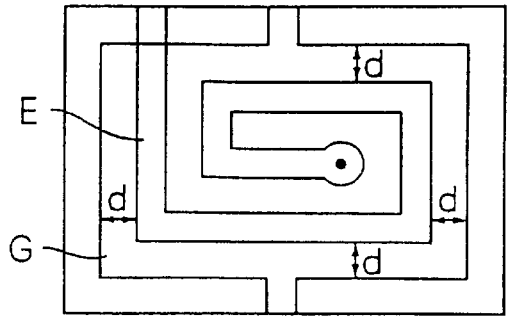
Figure 6C:
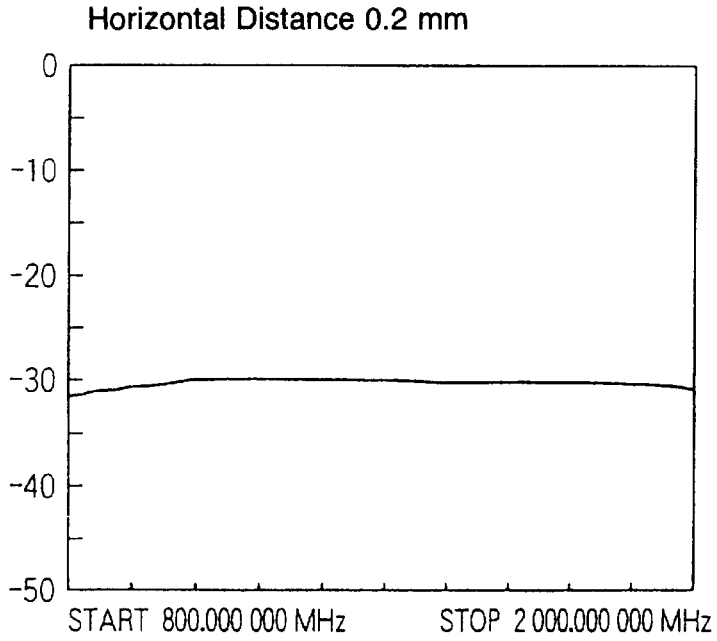
Figure 6D:
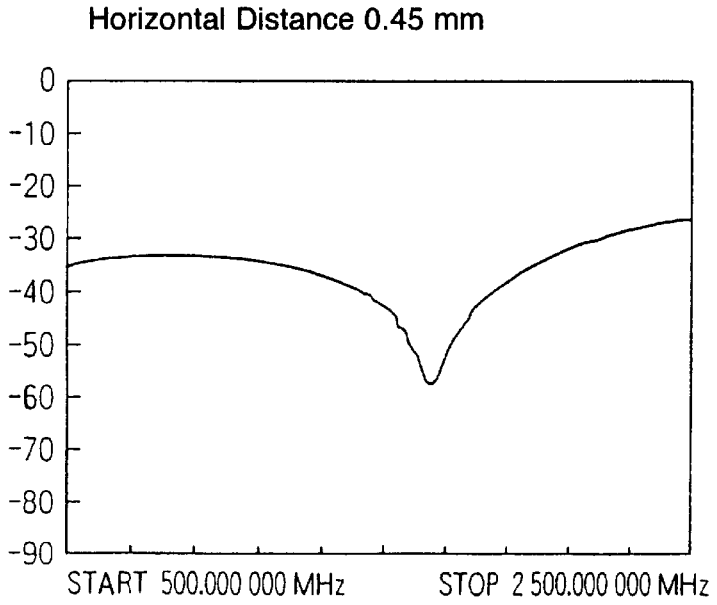

FIG. 5 shows a further embodiment of the present invention. In this embodiment, the laminated structure is substantially the same as in the embodiment of FIG. 1, however, the second intermediate dielectric layer 7 is formed with a spiral pattern 7*a* which provides a portion of the first coupling line and the spiral pattern 7*a* has an outer end connected with the lead 9. The inner end of the spiral pattern 7*a* is connected through the dielectric layer 7 with an end of the fifth portion 2*e* of the coupling line 2 on the first dielectric layer 3. It will therefore be understood that the first coupling line 2 is of a two layer structure. Similarly, the third intermediate dielectric layer 10 is formed with a conductor providing a spiral pattern 10*a* having an outer end connected with the lead 13. The inner end of the spiral pattern 10*a* is connected through the dielectric layer 5 with an end of the fifth portion 4*e* of the coupling line 4 on the second dielectric layer 5. This structure provides a second coupling line of two layer construction. In other respects, the structures are the same as in the embodiment of FIG. 1.

Referring now to FIG. 6, there is shown in (a) and (b) the relationship between the coupling line E and the grounding electrode G in the form of projections in the direction of the laminate thickness. As shown therein, the coupling line E has an outer edge which is located inside the edge of the grounding electrode by a distance d. In FIG. 6(*c*), there is shown an isolation characteristics obtained with the distance d of 0.2 mm. FIG. 6(*d*) shows an isolation characteristics obtained with the distance of 0.45 mm. In these drawings, it will be understood that a better isolation characteristics can be obtained with a larger distance d. In accordance with the present invention, a significant isolation characteristics can be obtained with the distance d of 0.3 mm or larger.

I claim:

1. A directional coupler including:

a first spiral pattern structure comprising a first dielectric layer provided at least on one surface with a single first coupling line and a second dielectric layer provided at least on one surface with a single second coupling line, the dielectric layers being laid one over the other so that the first and second coupling lines are located with dielectric material interposed therebetween, one end of the first coupling line being connected with one end of the second coupling line through a conductor passing through the dielectric material interposed between the first and second coupling lines to form a first spiral coupling line pattern;

a second spiral pattern structure comprising a third dielectric layer provided at least on one surface with a single third coupling line and a fourth dielectric layer provided at least on one surface with a single fourth coupling line, the third and fourth dielectric layers being laid one over the other so that the third and fourth coupling lines are located with dielectric material interposed therebetween, one end of the third coupling line being connected with one end of the fourth coupling line through a conductor passing through the dielectric material interposed between the third and fourth coupling lines to form a second spiral coupling line pattern;

said first and second spiral pattern structure being laid one over the other so that the first and second spiral coupling line patterns are located with dielectric material interposed therebetween;

two outer dielectric layers each having a grounding electrode extending to cover substantially throughout the surface thereof, the outer dielectric layers being laid over outer surfaces of the first and the second spiral pattern structures, respectively, with dielectric material interposed between the spiral coupling line patterns and the grounding electrodes, each of the first and second spiral coupling line patterns including a coupling line of a convolute configuration of at least one turn;

wherein the dielectric layers located at opposite sides of each of the first and second coupling lines are made of a material having a high specific dielectric constant, and other dielectric layers are made of a material having a relatively low dielectric constant.

2. A directional coupler in accordance with claim 1, which includes at least one dielectric layer outside each of the grounding electrodes for providing a protective layer.

3. A directional coupler in accordance with claim 2, wherein at least one of said dielectric layers having the grounding electrodes formed thereon is located with the grounding electrode inside the associated layer.

4. A directional coupler in accordance with claim 1, wherein each of the first and second coupling lines is formed on at least two dielectric layers.

5. A directional coupler including a first dielectric layer having a single first coupling line formed on one surface thereof, a second dielectric layer having a single second coupling line formed on one surface thereof, an intermediate dielectric layer disposed between the first and second dielectric layers, a third dielectric layer disposed outside the first dielectric layer and having a grounding electrode extending substantially throughout a surface thereof, a fourth dielectric layer disposed outside the second dielectric layer and having a grounding electrode extending substantially throughout a surface thereof, the layers being laid one over the other with a dielectric layer interposed between each grounding electrode and an adjacent one of the coupling lines, the first and second coupling lines being arranged so that they are located one over the other in a direction of lamination, each of the first and second coupling lines being of a spiral configuration including a first portion which extends in parallel with one edge of the dielectric layer on which the coupling line is formed, a second portion having one end connected with one end of the first portion and extending substantially perpendicularly to the first portion, a third portion having one end connected with the other end of the second portion and extending substantially perpendicularly to the second portion, a fourth portion having one end connected with the other end of the third portion and extending substantially perpendicularly to the third portion, and a fifth portion having one end connected with the other end of the fourth portion and located inside the first portion to extend substantially perpendicularly to the fourth portion, each of the first and second coupling lines having an edge which is located in a projection in the direction of lamination inside by a predetermined distance from an edge of the grounding electrode;

wherein each of the first and second coupling lines are connected at the other end of the first portion and the other end of the fifth portion with leads which extend to an edge portion of the laminated structure to form external connecting ports.

6. A directional coupler in accordance with claim 5, which includes at least one dielectric layer outside each of the grounding electrodes for providing a protective layer.

7. A directional coupler in accordance with claim 6, wherein at least one of said dielectric layers having the grounding electrodes formed thereon is located with the grounding electrode inside the associated layer.

8. A directional coupler in accordance with claim 5, wherein the other end of the first portion is connected through a lead to a port on the edge portion of the laminated structure and the other end of the fifth portion is connected through the dielectric layer adjacent to the coupling line with a lead formed on a surface of another dielectric layer which is in turn connected with the port on the edge portion of the laminated structure.

9. A directional coupler in accordance with claim 5, wherein each of the first and second coupling lines is formed on at least two dielectric layers.

10. A directional coupler including a first dielectric layer having a single first coupling line formed on one surface thereof, a second dielectric layer having a single second coupling line formed on one surface thereof, an intermediate dielectric layer disposed between the first and second dielectric layers, a third dielectric layer disposed outside the first dielectric layer and having a grounding electrode extending substantially throughout a surface thereof, a fourth dielectric layer disposed outside the second dielectric layer and having a grounding electrode extending substantially throughout a surface thereof, the layers being laid one over the other with a dielectric layer interposed between each grounding electrode and an adjacent one of the coupling lines, the first and second coupling lines being arranged so that they are located one over the other in a direction of lamination, each of the first and second coupling lines being of a spiral configuration including a first portion which extends in parallel with one edge of the dielectric layer on which the coupling line is formed, a second portion having one end connected with one end of the first portion and extending substantially perpendicularly to the first portion, a third portion having one end connected with the other end of the second portion and extending substantially perpendicularly to the second portion, a fourth portion having one end connected with the other end of the third portion and extending substantially perpendicularly to the third portion, and a fifth portion having one end connected with the other end of the fourth portion and located inside the first portion to extend substantially perpendicularly to the fourth portion, each of the first and second coupling lines having an edge which is located in a projection in the direction of lamination inside by a predetermined distance from an edge of the grounding electrode;

wherein the dielectric layers located at opposite sides of each of the first and second coupling lines are made of a material having a high specific dielectric constant, and other dielectric layers are made of a material having a relatively low dielectric constant.

11. A directional coupler in accordance with claim 10, which includes at least one dielectric layer outside each of the grounding electrodes for providing a protective layer.

12. A directional coupler in accordance with claim 11, wherein at least one of said dielectric layers having the grounding electrodes formed thereon is located with the grounding electrode inside the associated layer.

13. A directional coupler in accordance with claim 10, wherein each of the first and second coupling lines are connected at the other end of the first portion and the other end of the fifth portion with leads which are extending to an edge portion of the laminated structure to form external connecting ports.

14. A directional coupler in accordance with claim 13, wherein the other end of the first portion is connected through a lead to a port on the edge portion of the laminated structure and the other end of the fifth portion is connected through the dielectric layer adjacent to the coupling line with a lead formed on a surface of another dielectric layer which is in turn connected with the port on the edge portion of the laminated structure.

15. A directional coupler in accordance with claim 10, wherein each of the first and second coupling lines is formed on at least two dielectric layers.

* * * * *